US007027608B2

(12) United States Patent
Fretz et al.

(10) Patent No.: US 7,027,608 B2
(45) Date of Patent: Apr. 11, 2006

(54) BEHIND THE EAR HEARING AID SYSTEM

(75) Inventors: Robert J. Fretz, Maplewood, MN (US); Cliff Miller, Bloomington, MN (US); David Barnard, Madison, WI (US)

(73) Assignee: GN ReSound North America, Redwood City, CA (US)

( * ) Notice: Subject to any disclaimer, the term of this patent is extended or adjusted under 35 U.S.C. 154(b) by 111 days.

(21) Appl. No.: 09/341,994

(22) PCT Filed: Jul. 17, 1998

(86) PCT No.: PCT/US98/14795

§ 371 (c)(1),
(2), (4) Date: Oct. 28, 1999

(87) PCT Pub. No.: WO99/04601

PCT Pub. Date: Jan. 28, 1999

(65) Prior Publication Data

US 2003/0002700 A1 Jan. 2, 2003

Related U.S. Application Data

(60) Provisional application No. 60/053,031, filed on Jul. 18, 1997.

(51) Int. Cl.
*H04R 25/00* (2006.01)

(52) U.S. Cl. ..... 381/330; 381/322

(58) Field of Classification Search ..... 381/322, 381/327, 328, 330, 380, 381, 382; 181/128, 181/129, 130, 135

See application file for complete search history.

(56) References Cited

U.S. PATENT DOCUMENTS 1,830,198 A * 11/1931 French
2,991,333 A * 7/1961 Rose
3,080,011 A * 3/1963 Henderson
3,201,528 A * 8/1965 Johanson et al.
3,239,093 A * 3/1966 Gath
3,536,861 A 10/1970 Dunlavy
3,749,853 A * 7/1973 Ely et al.
3,934,100 A * 1/1976 Harada (Continued)

FOREIGN PATENT DOCUMENTS

| | | |
|---|---|---|
| DE | 3638747 | 10/1987 |
| DE | 4008982 | 9/1991 |
| DE | 4339899 | 6/1995 |
| EP | 0695 108 B1 | 6/1995 |
| EP | 0695108 | 1/1996 |
| GB | 792742 | 4/1958 |

*Primary Examiner*—Curtis Kuntz
*Assistant Examiner*—P. Dabney
(74) *Attorney, Agent, or Firm*—Michael J. Bolan; Bingham McCutchen LLP

(57) ABSTRACT

The hearing aid system includes a hearing aid case which is designed to be positioned behind the ear of a user, a tube for conducting sound from the case to the ear canal of the user, and a eartip for anchoring the end of the tube within the ear canal of the user. The tube is formed in a preformed shape of a material with sufficient rigidity to support the hearing aid in a proper position on the user's ear. The eartip may be one of several different designs which secures an end of the tube in place in the ear canal in a comfortable manner without the need for an expensive custom made ear mold and without complete occlusion of the ear canal. A combination of the light weight and small size of the case, the rigidity of the preformed tube, and one of the eartips for anchoring the tube in the ear canal allow the system to be held in place securely without the need for either an inflexible and aesthetically unpleasing ear hook or an expensive custom made ear mold.

23 Claims, 7 Drawing Sheets

U.S. PATENT DOCUMENTS 3,935,401 A * 1/1976 Shore et al.
3,975,599 A 8/1976 Johanson
3,983,336 A 9/1976 Malek et al.
4,090,040 A 5/1978 Berland
4,291,203 A 9/1981 Bellafiore
4,296,829 A * 10/1981 Pedersen
4,381,830 A 5/1983 Jelonek et al.
4,450,930 A 5/1984 Killion
4,751,738 A 6/1988 Widrow et al.
4,869,339 A 9/1989 Barton
4,904,078 A 2/1990 Gorike
5,031,219 A 7/1991 Ward et al.
5,033,090 A 7/1991 Weinrich
5,091,952 A 2/1992 William son et al.
5,113,967 A 5/1992 Killion et al.
5,201,006 A 4/1993 Weinrich
5,201,007 A 4/1993 Ward et al.
5,204,917 A * 4/1993 Arndt et al.
5,276,739 A 1/1994 Krokstad et al.
5,278,912 A 1/1994 Waldhauer
5,488,205 A * 1/1996 Major ..... 181/129
5,488,668 A 1/1996 Waldhauer
5,500,902 A 3/1996 Stockham, Jr. et al.
5,524,056 A 6/1996 Killion et al.
5,920,636 A * 7/1999 Oliveira ..... 381/328
5,987,146 A * 11/1999 Pluvinage et al.
6,000,492 A * 12/1999 Puthuff et al. ..... 181/135

* cited by examiner

BEHIND THE EAR HEARING AID SYSTEM

This application claims the benefit of Provisional Application No. 60/053,031, filed Jul. 18, 1997.

BACKGROUND OF THE INVENTION

1. Field of the Invention

The present invention relates to a behind the ear hearing aid system, and more particularly, the invention relates to a hearing aid system having an open ear canal hearing aid eartip.

2. State of the Related Art

Present day hearing aids have been developed to correct the hearing of users having various degrees of hearing impairments. Generally, hearing loss is not uniform over the entire audio frequency range. For example, hearing loss for sounds at high audio frequencies (above approximately 1,000 Hz) will be more pronounced for some people with certain common hearing impairments, while hearing loss for sounds at lower frequencies (below approximately 1,000 Hz) will be more pronounced for people having different hearing impairments.

The largest population of people having hearing impairments include those having mild hearing losses with normal or nearly normal hearing in the low frequency ranges and hearing losses in the higher frequency ranges. The most problematic sounds for people having such mild hearing losses are high frequency sounds at low amplitudes (soft, high-pitched sounds).

The traditional approach for correcting hearing impairments has been to employ either an electronic "in the ear" (ITE) hearing aid device inserted into the ear of the user or a "behind the ear" (BTE) hearing aid device attached behind the ear. The ITE hearing aid devices are custom made to fit within the ear and ear canal of the particular user. The BTE hearing aid devices include a flexible plastic tube connecting a behind the ear device to an ear mold placed within the ear. Both the ITE and BTE hearing aid devices tend to block the ear canal so that little or no sound can reach the ear in a natural, unaided manner.

Hearing aid systems which block the ear canal almost entirely cause a problem known as the occlusion effect. The occlusion effect is caused by the increased transmission of sound by bone conduction when the ear canal is blocked and ear conduction is impeded. This occlusion effect results in sounds which are unnatural and uncomfortable for the user. In particular, the user's voice sounds unnaturally higher than normal.

Some hearing aid systems have been made employing vents in the ear mold which reduce the occlusion effect partially. These vents allow the user to hear some natural sounds through a device positioned in the ear. Although vents provide some improvement in decreasing the occlusion effect, distortion of the user's voice remains a problem.

In an effort to alleviate some of the aforementioned problems, some BTE hearing aids have been designed with a flexible tube that extends into the ear canal and is held in place within the ear canal by an ear mold that leaves the ear canal generally unobstructed. Although the relatively open ear canal of these devices overcomes some of the occlusion effect, these hearing aids suffer from a number of other significant problems. For example, the BTE hearing aids employ a rigid plastic ear hook to secure the BTE device on the ear. The ear hook connects a hearing aid casing positioned behind the ear to a flexible plastic tubing which extends into the ear. The relatively large and rigid ear hook and the connection between the ear hook and the flexible tubing are visible and aesthetically unpleasing. The large size and visibility of the BTE hearing aid components results in a cosmetically unattractive device.

A flexible tube is used which can be cut to an appropriate length for a particular user. The ear mold which secures the end of the flexible hearing aid tube within the ear canal has to be custom manufactured to fit the user's ear to sufficiently secure the hearing aid tube in place in the ear canal and prevent the ear mold from falling out of the ear, for example, when the user is jogging. The custom made ear mold adds to the cost of the device and the time needed to fit the hearing aid.

There are some stock ear canal eartips available which are generally used during a trial period when the hearing aid is being tested or while the ear mold is being made. Some of these stock ear canal eartips are formed of hard materials, some are formed of solid rubber, and some are formed of foam. In general, stock ear canal eartips which are currently available have problems with holding the end of the flexible hearing aid tube securely in place. When these stock ear canal eartips fit tight enough to hold the tube in the ear they are usually uncomfortable.

Accordingly it would be desirable to address the above-described problems with a BTE hearing aid which avoids the occlusion effect, can be used without an expensive custom made ear mold, and provides an aesthetically pleasing and comfortable device.

SUMMARY OF THE INVENTION

The present invention relates to a hearing aid system having a hearing aid case positioned behind the ear and a preformed tube conducting sound from the hearing aid case to the ear canal. A combination of the preformed tube and an eartip holds the hearing aid in place comfortably and securely without the need for a customized ear mold or an ear hook.

In accordance with one aspect of the present invention, a hearing aid system includes a hearing aid case, a tube having a preformed shape connected to the hearing aid case, and an eartip. The hearing aid case is configured to be worn behind the ear of a user and contains a microphone, a processor unit, and a speaker for delivering amplified sounds to an output connector of the case. The tube has a first end for attaching to the output connector of the case and a second end for attaching to an eartip. The preformed shape of the tube includes a first bend extending from the case over the top of the ear of the user and a second bend extending from an outside of the ear into an ear canal of the user. The eartip is configured to fit within the ear canal while allowing sounds outside and within the ear to pass through the ear canal around the eartip.

According to an additional aspect of the present invention, a hearing aid tube for connecting a case of a behind the ear hearing aid to an eartip has an inner diameter of about 0.9 mm or less and an outer diameter of about 1.6 mm or less. The tube is preferably formed of a material with a durometer of 65 to 85 Shore D.

In accordance with another aspect of the present invention, a hearing aid case includes a case body configured to be worn behind the ear of a user, a battery compartment within the case, and a tube attachment end for connecting the case body to a hearing aid tube for delivering amplified sounds from the case body to an ear canal of the user. The case body contains a microphone, a processor unit, and a speaker. The tube attachment end includes an end surface for abutting an end of the hearing aid tube, a nipple extending from the end surface and configured to be received in the end of the hearing aid tube, the nipple having a longitudinal axis, a side surface for abutting a side surface of the hearing aid tube, and a key extending along the side surface in a direction substantially parallel to the longitudinal axis of the nipple. The key is arranged to maintain a proper orientation between the case body and the hearing aid tube when the hearing aid tube is connected to the case body.

According to an additional aspect of the present invention, a kit of parts for assembling hearing aids includes a plurality of tubes, a plurality of eartips for connection to the ear canal end of the tubes and configured to fit within the ear canal while allowing sound to pass through the ear canal around the eartip, and a plurality of behind the ear hearing aid cases including different sound processing components for connection to the tubes. The plurality of tubes each have a preformed shape including a hook for extending from the hearing aid case over a top of an ear of a user, a run extending from the top of the ear to the ear canal, and an ear canal end extending into the ear canal of the user. The plurality of tubes differ in a length of the run or a length of the ear canal end.

According to a further aspect of the present invention, a kit of parts for a behind the ear hearing aid includes a hearing aid housing containing amplification components, an eartip configured to fit within an ear canal of a user while allowing sound to pass through the ear canal around the eartip, a hearing aid tube having a first end configured to be connected to the hearing aid housing and a second end configured to be inserted into the eartip, and an inserting tool for inserting the second end of the hearing aid tube into the ear canal eartip. The inserting tool includes an elongated holder with an elongated recess configured to received a portion of the hearing aid tube adjacent to the second end.

According to another further aspect of the present invention, a hearing aid device includes an eartip adapted to be inserted into a human ear canal and to engage an anatomical structure of the canal, and a tube having a first end adapted to be connected to a source of sound and a second end adapted to be connected to the eartip. The tube is shaped to have a portion which engages the ear and a portion which extends into the ear canal. The tube has sufficiently rigidity to position and hold the eartip in the ear canal when the tube is engaged with the ear.

BRIEF DESCRIPTION OF THE DRAWING FIGURES

The invention will be described in greater detail with reference to the preferred embodiments illustrated in the accompanying drawings, in which like elements bear like reference numerals, and wherein.

DETAILED DESCRIPTION OF THE PREFERRED EMBODIMENTS

A hearing aid system according to the present invention includes a hearing aid case 10 which is designed to be positioned behind the ear of a user, a tube 12 for conducting sound from the case to the ear canal of the user, and an eartip 14 for anchoring the end of the tube within the ear canal of the user. The tube 12 is formed in a preformed shape of a material with sufficient rigidity to support the hearing aid in a proper position on the user's ear. The eartip 14 may be one of several different designs shown in FIGS. 10–21 and 23–29 which secures an end of the tube 12 in place in the ear canal in a comfortable manner without the need for an expensive custom made ear mold.

The system is designed to be particularly useful for those users experiencing mild to moderate hearing loss as an alternative to the known devices which may be uncomfortable, very visible, and expensive. A combination of the light weight and small size of the case 10, the rigidity and shape of the preformed tube 12, and the features of the eartips 14 for anchoring the tube in the ear canal allow the system to be held in place securely without the need for either an aesthetically unpleasing ear hook or an expensive and large custom made ear mold.

Figure 1:
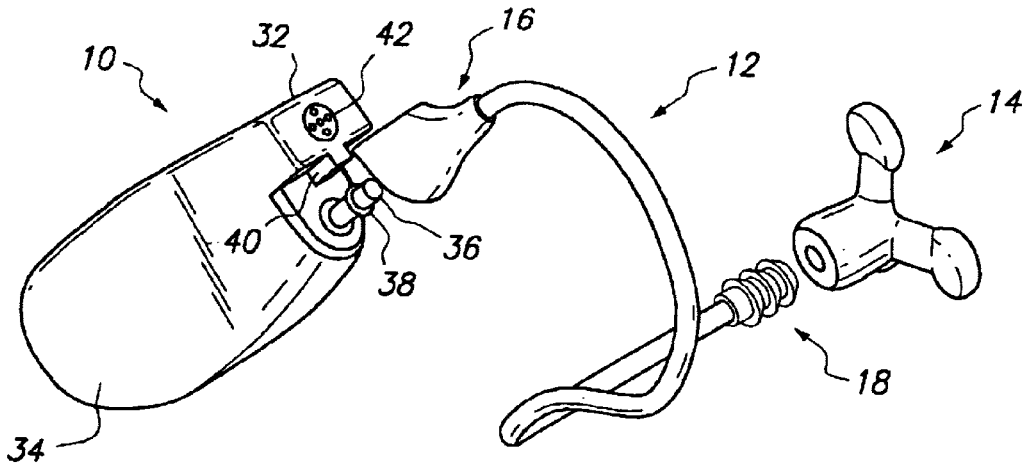
FIG. 1 is an exploded perspective view of a behind the ear hearing aid for the right ear according to the present invention.
Figure 2:
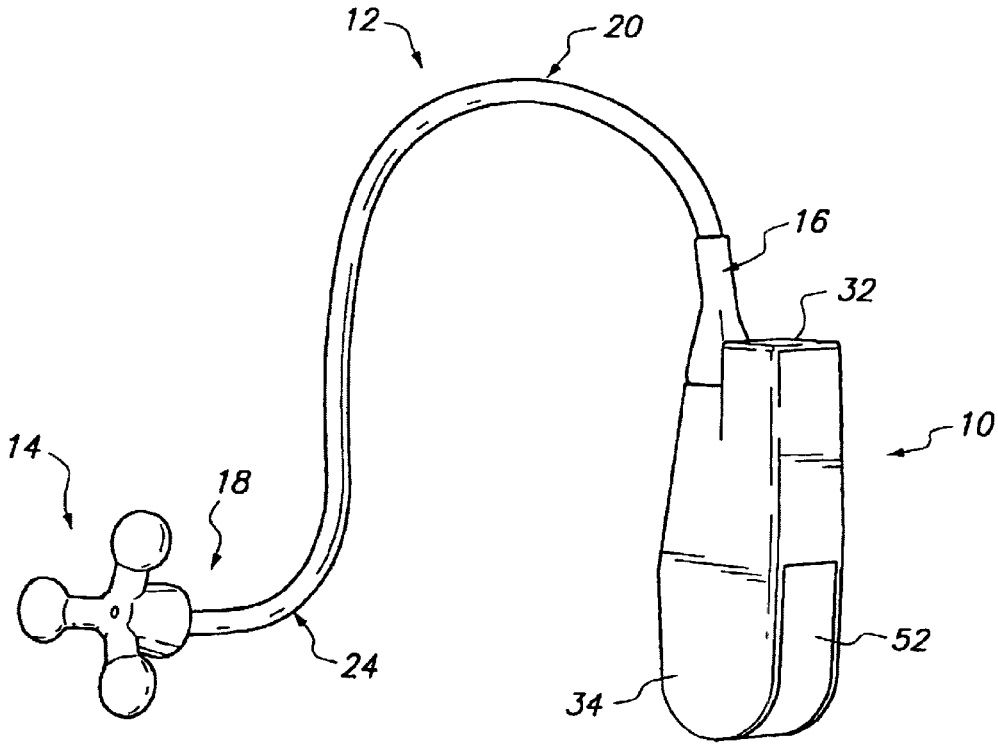
FIG. 2 is a rear perspective view of the hearing aid of FIG. 1.
Figure 3:
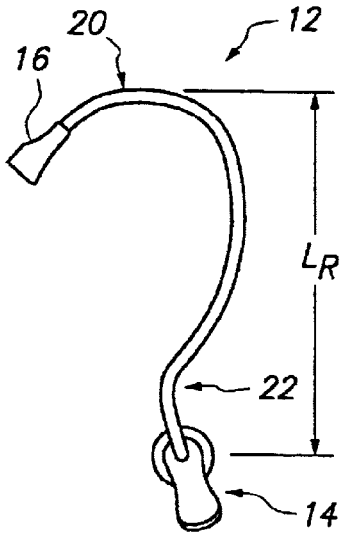
FIG. 3 is a side view of the hearing aid tube and eartip.
Figure 4:
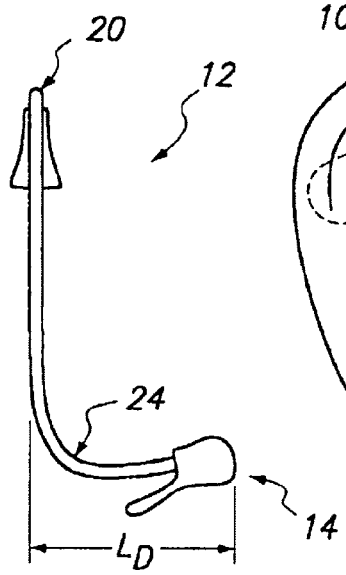
FIG. 4 is a front view of the hearing aid tube and eartip.

The tube 12 has a first end 16 which is configured to be attached to the hearing aid case 10 and a second end 18 which is configured to be inserted into the eartip 14. The tube 12 has a preformed shape which is shown in the views of FIGS. 1–5. The tube 12 includes a hook portion 20 near the first end 16 which is designed to extend from the case 10, located behind the ear, over the connecting point of the ear to the head. The hook portion 20 of the tube is curved substantially in a plane as seen in FIG. 4. From the hook portion 20, the tube continues to curve to a location where the tube bends to enter the ear canal. Just before the tube bends to enter the ear canal, a reverse bend 22 is provided which allows the tube to curve through the crus of the helix and behind the tragus. A lower bend 24 of the tube 12 extends from the outside of the ear into the ear canal. The lower bend 24 is located substantially in a plane which is approximately perpendicular to the plane in which the ear hook portion 20 lies.

A distance between a top of the hook portion 20 and a lowest part of the tube 12 where the tube bends to enter the ear canal is called the run and has a run length $L_R$. A distance between the point where the tube bends to enter the ear canal and the second end 18 of the tube is called a duck in length $L_D$. The appropriate run length $L_R$ and duck in length $L_D$ will vary somewhat between users. Accordingly, a tube 12 having the same general curvature is preferably provided in different sizes by providing two or more different run lengths $L_R$ and two or more duck in lengths $L_D$ to accommodate different users. In accordance with a preferred embodiment of the invention, the run length $L_R$ can be varied between about 3.0 and 3.45 cm and the duck in length $L_D$ can be varied between about 1.4 and 1.7 cm.

Figure 7:
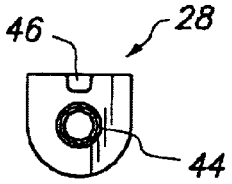
FIG. 7 is an end view of the hearing aid tube connection for connecting to the hearing aid case.
Figure 8:
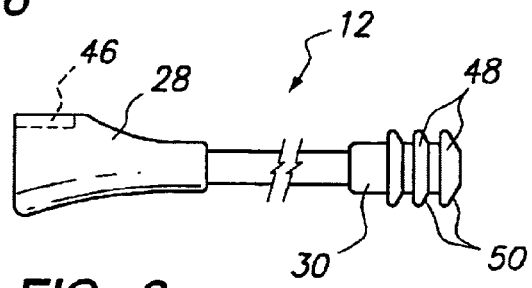
FIG. 8 is a side view of the hearing aid tube end connectors.
Figure 9:
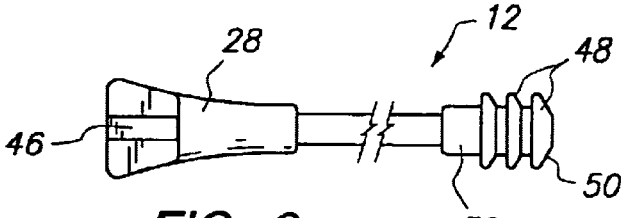
FIG. 9 is a top view of the hearing aid tube end connectors.

The tube 12 is formed in the shape described above by any known preforming process, such as, heat forming or UV light forming. The tube is preferably formed by fixing a connector member 28 at the first end 16 of the tube and fixing a honey dipper member 30 at the second end 18 of the tube. The connector member 28 and the honey dipper member 30 shown in FIGS. 7–9 are preferably overmolded onto the tube 12 by placing the tube into a mold which forms these end connector members. Alternatively, the connector member 28 and honey dipper member 30 may be molded first and then bonded to the tube 12. After the tube 12 is formed with the end members, a formed wire is positioned within the tube, thus bending the tube to the desired shape. The tube 12 is heated to shaped it in the preformed shape which is then retained by the tube upon cooling and removal of the wire. As one example, PeBax tubing is formed at about 120° C.

One method of improving the memory characteristics of the hearing aid tube 12 of the present invention is by electron beam radiation of the tube after the tube has been formed in the desired shape and heated to retain the shape. The cross linking established by the electron beam gives the tube a permanent memory of the desired shape that is maintained even in the presence of heat or long periods of deformation.

The tube 12 is formed with an outer diameter of about 1.0 to 1.6 mm, preferably about 1.2 mm and an inner diameter of about 0.5 to 0.9 mm, preferably about 0.7 mm. This is substantially smaller than the flexible tubing used in known hearing aids which has outer diameters of about 3.0 mm. The known tubing at about twice the size of the tubing of the present invention is very visible. Although there is a trade-off between inner tube diameter and sound level output of the tube, tubes having an inner diameter of as small as about 0.5 mm have been found to provide sufficient sound level output for hearing aids designed for mild and moderate hearing loss users.

The material of the tube 12 may be any material which can be formed in a preformed shape and exhibits sufficient rigidity to hold the eartip 14 within the ear canal and retains it's shape when positioned on the ear. Examples of tube materials include FEP Teflon, Nylon, PEBAX, silicone, polyurethane, PTFE (polytetrafluoroethylene), EVA (ethylvinylacetate), and the like. The material of the tube 12 has a shore hardness of about 65 to 85 Shore D, preferably about 72 Shore D. The relative rigidity of the tube 12 allows the tube to apply a torque to the eartip 14 to maintain the eartip in a position in which the eartip is pressed against an anatomical feature within the ear canal. This ability to apply a torque to the eartip 14 with the tube 12 provides a substantial improvement over flexible tubing used in known BTE hearing aids in which the ear mold must fix the end of the tube in the ear and the tube provides no retention or support of the hearing aid device.

Figure 30:
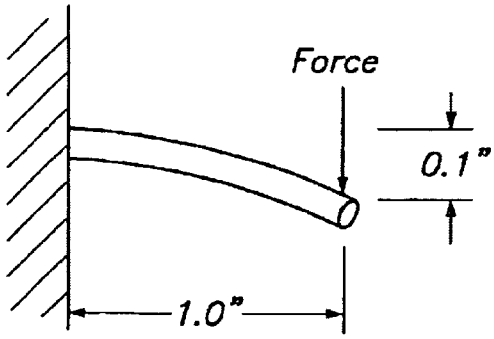
FIG. 30 is a side view of the setup for a tube bending test.

FIG. 30 is a schematic view of a test used to compare the flexibility of a tube according to the present invention to a prior art tube. The tubing of the invention which was tested was a PEBAX tube having an inner diameter of 0.7 mm, an outer diameter of 1.2 mm, and a durometer of 72 Shore D. The prior art tubing tested had an inner diameter of 1.9 mm, an outer diameter of 3.0 mm, and was formed of PVC. A one inch (2.54 cm) piece of tube was tested for both the prior art and the invention.

Figure 31:
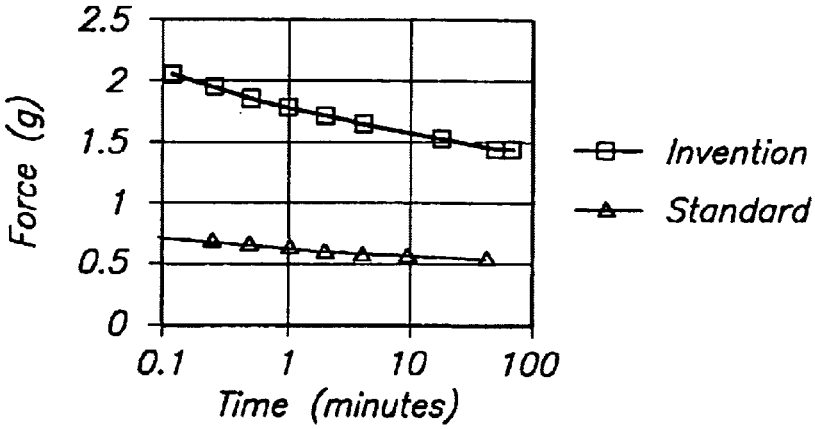
FIG. 31 is a graph of the results of a tube bending test comparing a tube according to the present invention to a standard hearing aid tube.

As shown in FIG. 31, the force required to bend a one inch (2.54 cm) piece of the standard PVC flexible tubing 0.1 inch (2.54 mm) is lower than the force required to bend the more rigid tubing of the present invention. Even though the improved tubing is much thinner and hence, substantially more cosmetically attractive, it is also substantially stiffer. As shown in FIG. 31, the force required to deflect the improved tube is about 1.4 to 2.1 g which is two or three times higher than the force required to deflect the standard hearing aid tubing.

Figure 5:
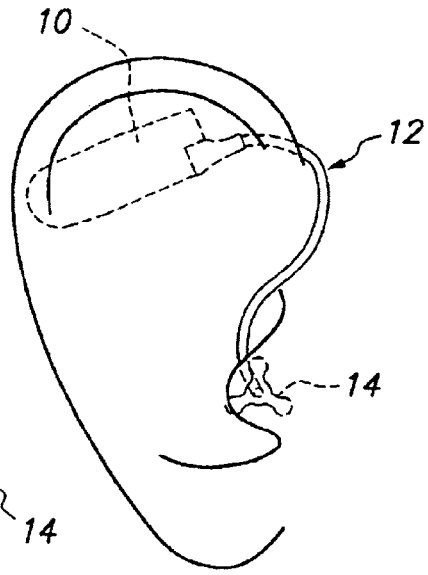
FIG. 5 is a side view of the hearing aid of FIG. 1, positioned on a user's right ear.
Figure 6:
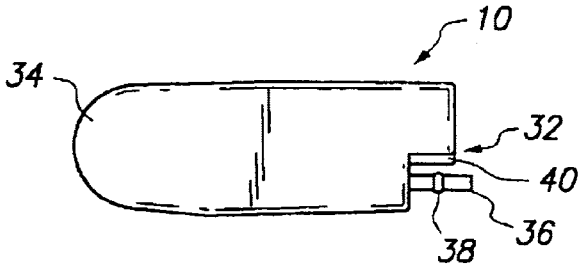
FIG. 6 is a side view of the hearing aid case.

The hearing aid case 10 as shown in FIGS. 5 and 6 is sized to fit behind the user's ear. The case 10 has a curved lower end 34 and an attachment end 32 for connection to the connector member 28 of the tube. The case has an overall length which is less than about 2.5 cm, compared to standard BTE devices with overall lengths of about 3.05 to 4.3 cm. One example of a hearing aid case 10 according to the present invention has dimensions of approximately 2.16 cm×0.81 cm×0.61 cm. Typically, the hearing aid case 10 including electronics and a battery has a weight of about 1.25 g compared to known BTE devices having weights of about 2.7 to 4.4 g. The small size and light weight of the case 10 allows the case to be held behind the ear by the small preformed tube 12 without the need for an inflexible and aesthetically unattractive ear hook and the large custom eartips used in known BTE systems. The case 10 includes a microphone 42 at the attachment end 32 and a battery compartment door 52 at the lower end 34.

The attachment end 32 of the case 10 includes a nipple 36 through which sound is conducted from a speaker inside the case into the tube 12. The nipple 36 includes an annular retention ring 38 which allows the connector member 28 of the tube to snap onto the nipple. The attachment end also includes a rectangular key member 40 which corresponds with a keyway 46 in the connector member 28 to insure that a proper orientation between the case 10 and the tube 12 is achieved when the tube is snapped onto the case.

The case 10 encloses the electronic components including a microphone, a processor unit, and a speaker for delivering amplified sounds to the tube 12. One example of a system for amplification of sounds includes a compressor which adjusts the gain as a function of an amplitude level detected, and is described in U.S. patent application Ser. No. 08/781,714 which was filed Jan. 10, 1997 and is incorporated herein by reference. According to the present invention, multiple hearing aid cases may be provided with processors having different frequency responses for use by users having different hearing losses. Further, the cases may be provided in a plurality of colors for aesthetic or color coding purposes.

The connector member 28 and the honey dipper member 30 are illustrated in further detail in FIGS. 7–9. The connector member 28 includes a bore 44 which is received on the nipple 36 of the case 10. The bore 44 includes an internal recess which corresponds to the retention ring 38 on the nipple providing the snap fit. The connector member 28 also includes a keyway 46 which is shaped to be received on the key 40 of the case as the tube 10 is attached to the case to achieve a proper orientation of the tube.

The honey dipper member 30 is a cylindrical member having three annular ribs 48. The ribs 48 each have an angled or tapered forward surface 50 which assists in inserting the honey dipper member 30 into one of the eartips 14. The connector member 28 and the honey dipper member 30 are preferably formed of a material which is flexible enough to slide over the retention ring 38 but rigid enough to hold the tube securely once in place. Materials having durometers of about 25 to 60 Shore D, preferably about 40 Shore D provide the desired flexibility.

Figure 9A:
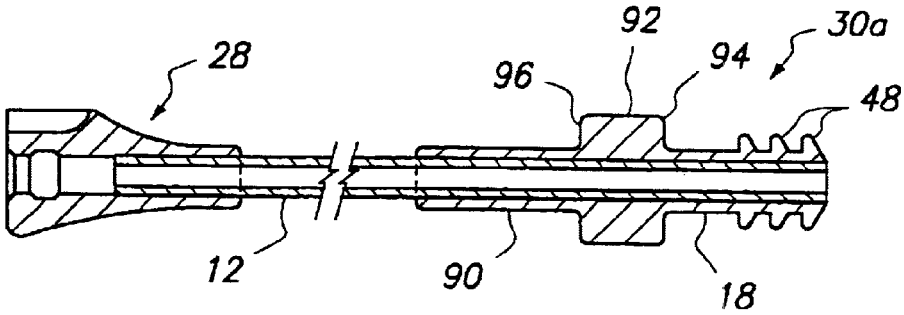
FIG. 9A is a side cross sectional view of an alternative embodiment of the hearing aid tube end connectors.

FIG. 9A is a side cross sectional view of an alternative embodiment of a tube with a honey dipper member 30*a*. The honey dipper member 30*a* includes an elongated sleeve 90 extending over the second end 18 of the tube 12. The sleeve 90 has an enlarged cylindrical shoulder 92 spaced from the ribs 48 of the honey dipper member 30*a*. The sleeve 90 provides the multiple functions of (1) stiffening the tube 12 to make installing the eartip 14 and inserting the tube into the ear canal easier; (2) providing a visual indication of correct placement of the eartip 14 on the tube 12; (3) providing a surface to grasp when installing the eartip; and (4) providing a surface to engage with the finger to push the eartip into the ear canal.

The shoulder 92 has a first surface 94 which abuts the eartip 14 when the eartip is fully installed on the tube 12. This visual and tactile indication of proper positioning of the eartip 14 on the tube 12 guides the user in proper installation. Improper installation of the eartip 14 may result in the eartip becoming separated from the tube 12 in the ear canal.

The shoulder 92 also has a second surface 96, opposite the first surface 94, which gives the user something to grasp when installing the eartip 14 and allows the user to push the eartip and tube into the ear by engaging the second surface with the finger tip or fingernail.

The sleeve 90 extends a distance of about 1.2 to 1.5 cm, preferably about 1.27 cm along the tube 12. This distance is generally less than or equal to the duck in length $L_D$ of the tube. The sleeve 90 is preferably formed of the same or a similar material and color as the tube 12 to maintain cosmetics. However, during use, the sleeve 90 will generally be hidden within the ear and the ear canal.

The eartips 14 for connection to the honey dipper member 30, 30*a* or the tube 12 are described below with respect to FIGS. 10–21 and 23–29.

Figure 10:
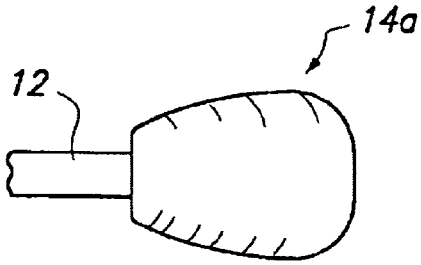
FIG. 10 is a side view of a bud-shaped eartip.
Figure 11:
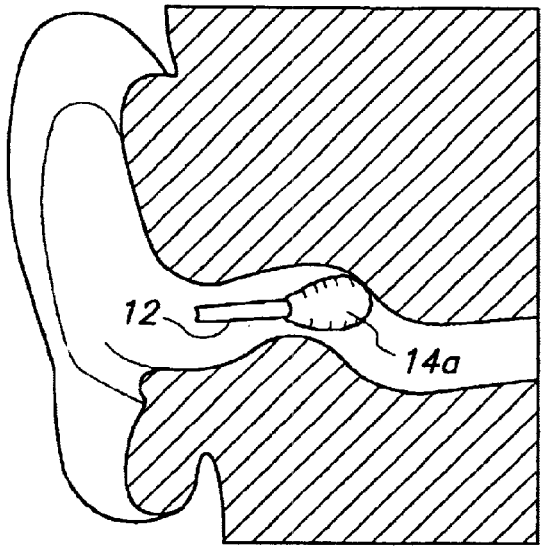
FIG. 11 is a cross sectional view of the ear canal looking from the front of the head at the right ear with the bud-shaped eartip securing the end of the tube in place.
Figure 12:
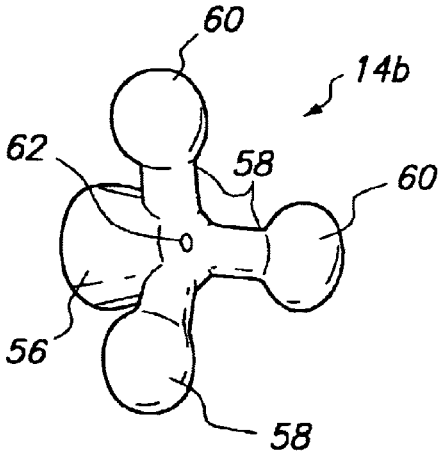
FIG. 12 is a perspective view of a flower-shaped eartip.
Figure 13:
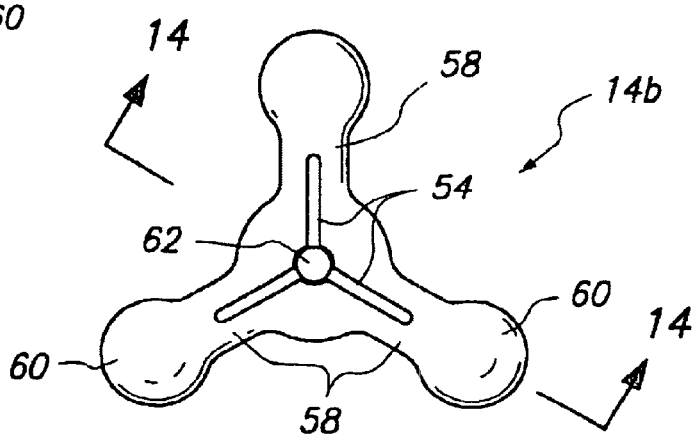
FIG. 13 is an end view of the flower-shaped eartip.

A bud-shaped hearing aid eartip 14*a* is illustrated in FIGS. 10 and 11. The bud-shaped eartip 14*a* is a conically shaped member having a through bore for sound transmission and an interior socket configured to allow the bud-shaped eartip to be received on the honey dipper end 30 of the tube 12. As shown in FIG. 11, the bud-shaped eartip 14*a* functions by "hooking" up under the roof or superior surface of the ear canal. The stiffness of the tube 12 holds the bud-shaped eartip 14*a* in this position. The bud-shaped eartip 14*a* is particularly suited for users having an upward slanting ear canal or a narrow section of the ear canal roof in which the bud-shaped eartip grabs well. The bud-shaped eartip according to one embodiment of the invention has an overall length of about 6.3 mm and a diameter at a widest part of about 5.6 mm.

Figure 14:
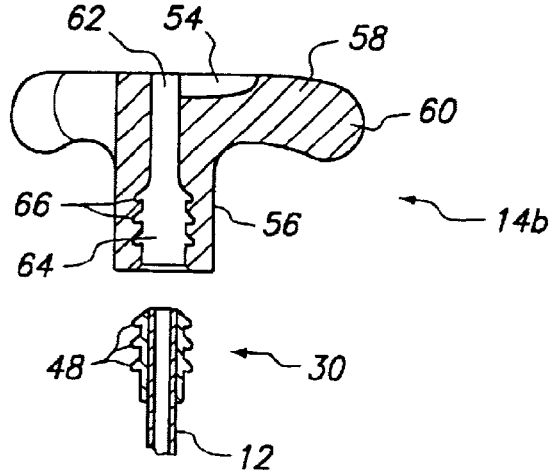
FIG. 14 is a side cross sectional view of the flower-shaped eartip and the end connector of the tube.
Figure 15:
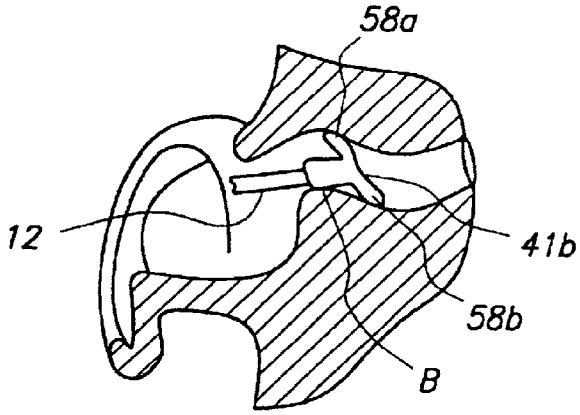
FIG. 15 is a cross sectional view of the ear canal looking down from above at the left ear with the flower-shaped eartip securing the end of the tube in place.

FIGS. 12–15 illustrate a flower-shaped eartip 14*b* including a central core 56 and three flower petals 58 extending from the central core. Each of the petals 58 has a substantially ellipsoidal shaped end 60. Most people have a first bend B in the ear canal that allows one or more of the petals 58 to extend behind the bend and grab the ear canal behind the bend to retain the flower-shaped eartip 14*b* in the ear canal. As shown in FIG. 15, an anterior petal 58*a* applies a gentle force which keeps the posterior blades 58*b* behind the first bend B. The flower-shaped eartip 14*b* may include a plurality of grooves 54 extending radially outward from a through bore 62 at the posterior end of the eartip. These grooves 54 provide more area for the sound to exit the eartip but due to their narrow dimension prevent wax entrance. The grooves 54 also make it easier for wax to be removed from the through bore 62 if it does enter.

FIG. 14 is a cross sectional view of the flower-shaped eartip 14*b* illustrating the through bore 62 and interior socket 64 for receiving the honey dipper member 30 of the tube 12. The interior socket 64 is configured with internal circular grooves 66 to accommodate the ribs 48 of the honey dipper member 30.

Figure 16:
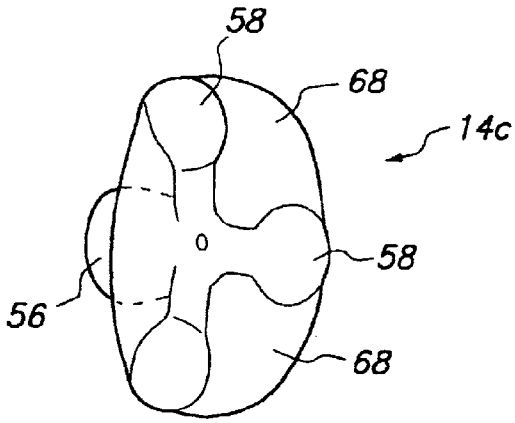
FIG. 16 is a perspective view of the flower-shaped eartip with webbing.

Another variation of the flower eartip is the webbed flower eartip 14*c* of FIG. 16 in which the flower petals 58 are connected by a thin web 68 of eartip material. The webbed flower eartip 14*c* will reduce the ambient sound passage through the ear canal increasing occlusion. The increased occlusion provided by the webbed flower eartip 14*c* may be desirable for some users in order to increase the gain in the 1 to 2 kHz frequency range or to reduce the occurrence of feedback oscillation. The webbed flower eartip 14*c* will also provide added retention by the contact between the web 68 and the ear canal surfaces. The webbed flower eartip 14*c* and flower-shaped eartip 14*b* may have an overall length of about 6.8 mm and a length from a center of the core to an end of a petal of about 5.4 mm.

Figure 17:
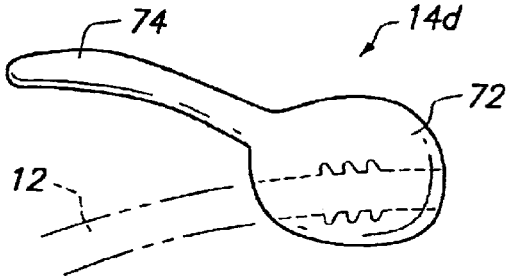
FIG. 17 is a side view of the guppie-shaped eartip.
Figure 18:
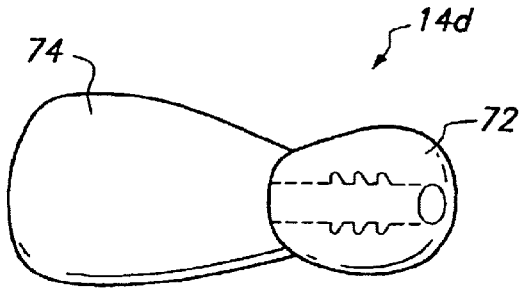
FIG. 18 is a top view of the guppie-shaped eartip.
Figure 19:
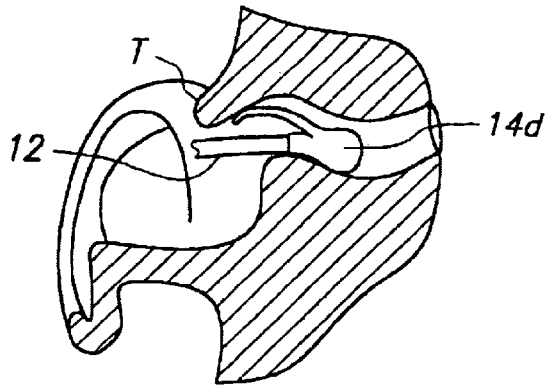
FIG. 19 is a cross sectional view of the ear canal looking down from above at the left ear with the guppie-shaped eartip securing the end of the tube in place.

A fourth eartip design is the guppie-shaped eartip 14*d* of FIGS. 17–19 which includes a central body portion 72 and a tail 74. As seen in the top view of FIG. 18 the tail 74 is a rounded petal shaped member. The tail 74 hooks behind the tragus T of the ear canal as shown in FIG. 19 to provide retention in the ear canal of a user. The tail 74 has a soft spoon shaped surface which is pressed gently against the surface under the tragus T. Again, the stiffness of the tube 12 keeps the guppie-shaped eartip 14*d* properly oriented and positioned within the ear canal.

Figure 20:
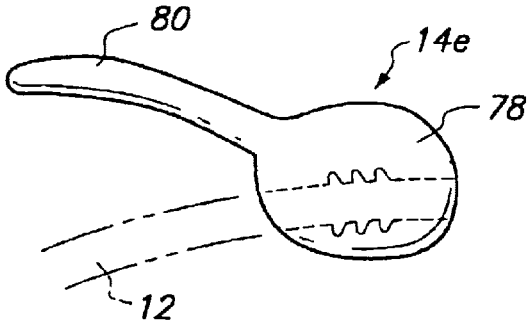
FIG. 20 is a side view of a barb-shaped eartip.
Figure 21:
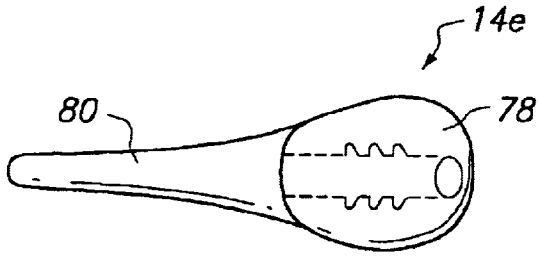
FIG. 21 is a top view of the barb-shaped eartip.

A fifth eartip design shown in FIGS. 20 and 21 is the barb-shaped eartip 14*e* including a central body portion 78 and a barb 80 extending from the central body portion. The barb-shaped eartip 14*e* is somewhat less occluding than the guppie-shaped eartip 14*d* and operates in substantially the same manner as the guppie-shaped eartip. The guppie or barb-shaped eartips according to one embodiment may have an overall length of about 14.0 mm and a diameter at a widest part of about 5.6 mm. However, the dimensions which have been described are merely examples of the eartip dimensions which may be used.

A further eartip design shown in FIGS. 23–27 is a dome-shaped eartip 14*f* having a bud-shaped core 100 and a skirt 102 starting about half way down the bud-shape and extending from the core. The dome-shaped eartip 14*f* has an interior socket 104 for receiving the honey dipper member 30, 30*a* and a through bore 106 for sound delivery. A U-shaped groove 108*a* extends across the core 100 and intersects the through bore 106. The U-shaped groove 108*a* and a second groove 108*b* increase the cross sectional area through which sound exits the eartip 14*f* and provide four vent holes 109 through the eartip beneath the skirt 102. The vent holes 109 allow sound to pass through the eartip. These vent holes may be omitted in an occluding version of the eartip.

The dome-shaped eartip 14*f* also includes a wax guard 110 in the form of an integral bridge member which extends substantially perpendicular to the U-shaped groove 108*a*. The wax guard 110 is an arch shaped member which serves as a barrier for direct entry of wax into the through bore 106. Although the preferred embodiment of the dome-shaped eartip 14*f* includes the wax guard 110, the eartip may also be formed without a wax guard, with a wax flap as shown in FIGS. 28 and 29, or with any of the wax guards which are known in the art.

The dome-shaped eartip 14*f* may be provided in different sizes with varying size skirts 102. The eartip 14*f* functions similar to the guppie-shaped eartip 14*d* or flower-shaped eartip 14*b* with the skirt 102 grabbing under the tragus or around the first bend in the ear canal.

Figure 28:
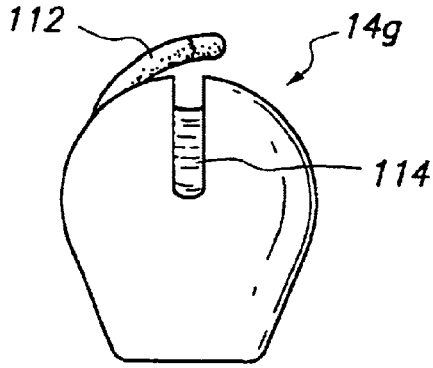
FIG. 28 is a side view of an alternative embodiment of a bud-shaped tip with a wax guard.
Figure 29:
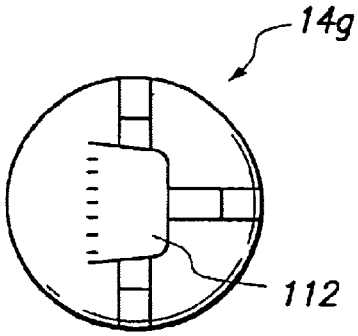
FIG. 29 is a front view of the bud-shaped tip of FIG. 28.

A final eartip design shown in FIGS. 28 and 29 is a bud-shaped eartip 14*g* having a wax flap 112. The eartip 14*g* includes three grooves 114 forming a T-shape which is centered on the sound delivery bore of the eartip. The wax flap 112 extends over the sound delivery bore and prevents direct entry of wax into the bore which may cause occlusion of the eartip. The flap 112 is flexible enough to be pushed down when inserting the eartip 14*g* but will spring back up. Sound can exit around the flap 112 through the grooves 114 of the eartip even when the flap is pushed down. The wax flap 112 or the wax guard 110 can be incorporated in any of the eartips 14 which have been described above to improve operation of the hearing aid system by preventing wax blockage.

The plurality of different eartip shapes are provided because the shape of the ear canal and sensitivity differs from one user to another. For example, some users seem to be more sensitive to pressure in an area behind the first bend in the ear canal. For these users the guppie-shaped eartip 14*d* may be most comfortable because it does not contact this area. In addition, eartips may be provided in different sizes to accommodate differences in the anatomy of users.

The eartips 14 are formed of a resilient material which is clear or darkly colored to be less visible. The eartip material may be a soft elastomer, such as silicone rubber or other soft plastic. The eartip material preferably has a durometer of about 30 Shore A. Alternatively, the eartips 14 may be formed of a foam material. In particular, foam eartips may be used to provide a significant blockage of the ear canal for users needing high gains where other eartips do not provide enough occlusion of the canal.

Figure 22:
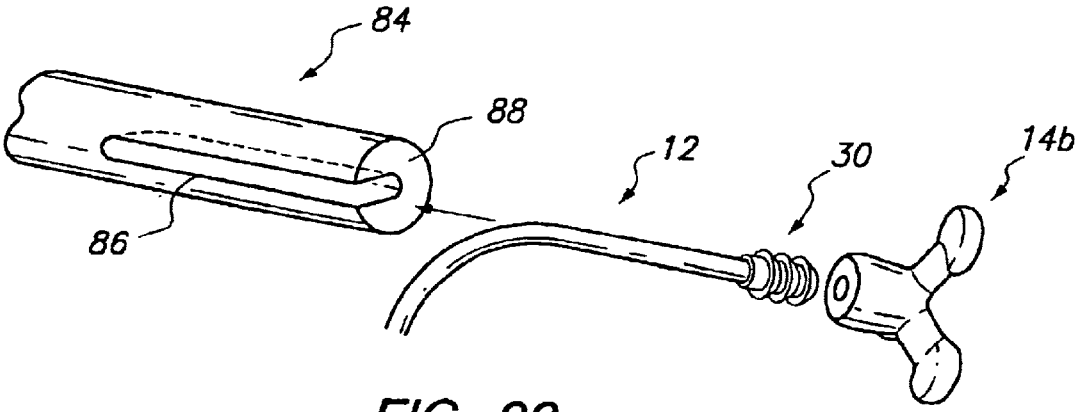
FIG. 22 is an exploded view of the insertion tool, the hearing aid tube, and the flower-shaped eartip.
Figure 23:
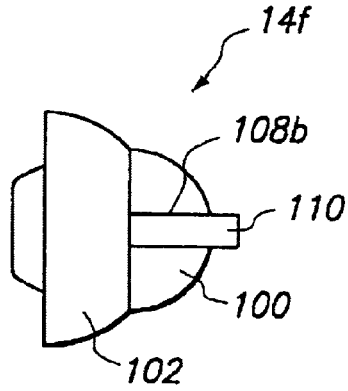
FIG. 23 is a side view of a dome-shaped eartip.
Figure 24:
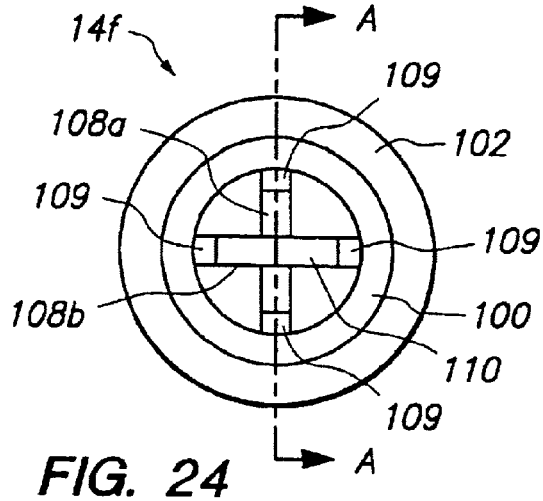
FIG. 24 is a front view of the dome-shaped eartip.
Figure 25:
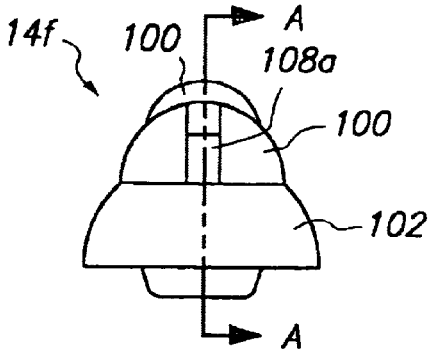
FIG. 25 is an alternate side view of the dome-shaped eartip.
Figure 26:
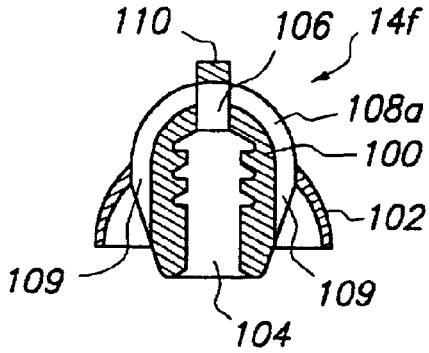
FIG. 26 is a cross sectional view of the dome-shaped eartip taken along line A—A of FIGS. 24 and 25.
Figure 27:
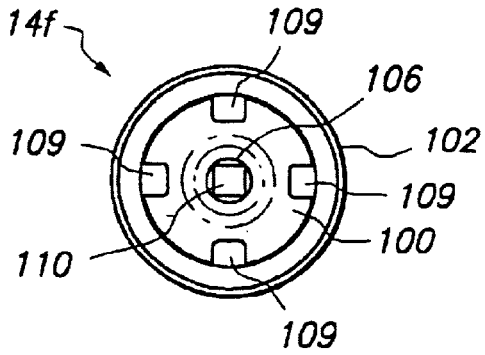
FIG. 27 is a back view of the dome-shaped eartip.

FIG. 22 illustrates the insertion of the honey dipper member 30 of the tube 12 into the flower-shaped eartip 14*b* with the assistance of an insertion tool 84. Due to the small size of both the tube 12 and the eartips 14, and the resilience of the eartips it may be difficult for some people to manually insert the tube into the eartip when assembling the hearing aid. The insertion tool 84 is an elongated rod having a longitudinal slit 86 extending in a longitudinal direction along the rod from an end surface 88. The slit 86 has a rounded bottom surface and is sized to accommodate a portion of the tube 12 adjacent the honey dipper member 30. The insertion tool 84 assists in inserting the tube 12 into the eartip 14 by placing a portion of the tube into the longitudinal slit 86 of the rod until the end surface 88 of the tool abuts the honey dipper portion 30. The tube 12 is stabilized by the insertion tool 84 by grasping the tool and tube together during installation of the eartip 14.

The hearing aid system which has been described above provides significant advantages in user comfort and aesthetics over known systems. A combination of the light weight case 10, the relatively rigid and smaller shaped tube 12 and the comfortable eartip 14 provide a secure and comfortable fit. The small transparent preformed tube 12 is substantially more discrete than the ear hook and tube combination used in the known system.

While the invention has been described in detail with reference to the preferred embodiments thereof, it will be apparent to one skilled in the art that various changes and modifications can be made an equivalents employed, without departing from the present invention.

What is claimed is:

1. A hearing aid system, comprising:

a hearing aid case configured to be worn behind tire ear of a user, the case containing a microphone, a processor unit, a tube attachment end surface, an output connector having a nipple extending from the tube attachment end surface along a longitudinal axis, and a speaker for delivering amplified sounds to the output connector;

a tube having a first end for attaching to the output connector and a second end, the tube having a preformed shape including a first bend extending front the case over the top of the ear of the user and a second bend extending from an outside of the ear into an ear canal of the user;

a key and a corresponding keyway, the key extending substantially parallel to the longitudinal axis of the nipple, the key and corresponding keyway armed to maintain a specific orientation between the case and the tube when the tube is connected to the case; and an eartip connected to the second end of the tube and configured to fit within the ear canal while allowing sounds outside and within the ear to pass tough the ear canal around the eartip.

2. The hearing aid system according to claim 1, wherein the tube has a rigidity sufficient to hold the ear canal eartip in the ear canal and the case behind the ear.

3. The hearing aid system according to claim 1, wherein the first bend is located substantially in a first plane and the second bend is located substantially in a second plane which is approximately perpendicular to the first plane.

4. The hearing aid system according to claim 1, wherein the tube is formed of a material having a durometer of about 65 to 85 Shore D.

5. The hearing aid system according to claim 1, wherein the tube has an inner diameter of about 0.9 mm or less and an outer diameter of about 1.6 nun or less.

6. The hearing aid system according to claim 1, wherein the hearing aid case including a battery has a mass of 1.5 grams or less.

7. The hearing aid system according to claim 1, wherein the nipple includes the key.

8. The hearing aid system according to claim 7, wherein the first end of the tube includes the corresponding keyway.

9. The hearing aid system according to claim 1, wherein the tube is formed of a sufficiently rigid material that a 1 inch segment of the tube is deflected by less than 0.1 inches by a force of 1 g.

10. The hearing aid system according to claim 9, wherein the tube has an outer diameter of about 1.6 nun or less.

11. The hearing aid system according to claim 10, wherein the tube has been formed at high temperature to retain the first and second bends.

12. The hearing aid system of claim 1, wherein the tube comprises formed of a material with a durometer of about 65 to 85 Shore D.

13. A hearing aid case comprising:

a case body configured to be worn behind the ear of a user, the case body containing a microphone, a processor unit, and a speaker, said case body including an attachment end surface, said microphone located at said attachment end surface;

a battery compartment within the case body;

a hearing aid tube for delivering amplified sounds from the speaker to an ear canal of the user, said hearing aid tube adapted to be inserted within said ear canal;

a nipple extending from the attachment end surface anal configured to be received in an end of the hearing aid tube, the nipple laying a longitudinal axis; and a key and a corresponding keyway, said key extending substantially parallel to the longitudinal axis of the nipple, the key and corresponding keyway arranged to maintain a specific orientation between the case body anal the nearing aid tube when the hearing aid tube is connected to the case body.

14. The hearing aid case according to claim 13, comprising:

an annular retention ring on the nipple; and a recess on an internal surface of see hearing aid tube, wherein the recess and said the annular retention ring operate cooperatively to retain the hearing aid tube in a snap fit.

15. A kit of parts for a behind the ear hearing aid comprising:

a hearing aid housing containing amplification components;

an eartip configured to fit within an ear canal of a user while allowing sound to pass through the ear canal around the eartip;

a hearing aid tube having a first end configured to be connected to the hearing aid housing and a second end configured to be inserted into the eartip, wherein said second end of said hearing aid tube includes at least one rib and wherein an internal surface of said eartip includes at least one groove configured to accommodate said at least one rib; and an inserting tool for inserting the second end of the hearing aid tube into the ear canal eartip, the inserting tool comprising:

an elongated holder;

an elongated recess within said elongated holder, said elongated recess configured to received a portion of the hearing aid tube adjacent to the second end;

an end surface of said elongated holder configured to about said at least one rib in use.

16. The hearing aid system according to claim 1, wherein the eartip has a flower-shape with a plurality of petals extending from a central core configured so that the petals fit around the first bend of the ear canal.

17. The hearing aid system according to claim 1 wherein, the eartip includes a single blade extending from a central core configured so that the blade fits behind the ear tragus.

18. The hearing aid system according to claim 1, wherein the eartip is a cortically-shaped member having first cross sectional dimension at a first end which is connected to the tube and a second cross sectional dimension which is larger than the first dimension at a second free end.

19. The hearing aid system according to claim 1, wherein the eartip is a dome-shaped member having an annular skirt extending from a central core.

20. The hearing aid system according to claim 19, wherein the dome-shaped eartip has a plurality of vent holes.

21. The hearing aid system according to claim 19, wherein the dome-shaped eartip includes a wax guard.

22. The hearing aid system according to claim 1, wherein said the eartip comprises an interior socket with a plurality of internal circular grooves and the second end of the tube comprises a cylindrical member with a plurality of annular ribs on the surface of the cylindrical member, the annular ribs being adapted to be accommodated to the plurality of internal circular grooves.

23. The hearing aid system according to claim 1, wherein the eartip comprises an interior socket with a plurality of internal circular grooves and the second end of the tube comprises a cylindrical member with a plurality of annular ribs on the surface of the cylindrical member, the annular ribs being adapted to be accommodated to the plurality of internal circular grooves.

* * * * *